United States Patent [19]

Huf

[11] 3,941,524

[45] Mar. 2, 1976

[54] ROTARY PISTON ENGINE HAVING A TROCHOIDAL PISTON AND ANNULARLY-CLOSED AXIAL SEALS IN THE PISTON

[75] Inventor: Franz Huf, Constance, Germany

[73] Assignee: Dornier System GmbH., Germany

[22] Filed: Jan. 29, 1975

[21] Appl. No.: 545,200

[30] Foreign Application Priority Data

Feb. 13, 1974 Germany ..... 2406755

[52] U.S. Cl. ..... 418/99; 418/142

[51] Int. Cl.[2] ..... F04C 29/02

[58] Field of Search ..... 418/83, 99, 142, 76

[56] References Cited

UNITED STATES PATENTS

| | | | |
|---|---|---|---|
| 3,111,820 | 11/1963 | Atchison | 418/99 X |
| 3,213,837 | 10/1965 | Keylwert | 418/99 |
| 3,814,555 | 6/1974 | Casey | 418/142 X |

*Primary Examiner*—John J. Vrablik
*Assistant Examiner*—Leonard Smith
*Attorney, Agent, or Firm*—James E. Bryan

[57] ABSTRACT

This invention relates to an improvement in a rotary piston machine comprising a jacket and two side parts forming a housing, inlet and outlet means on said housing, a piston patterned after a saddle-free epitrochoid 1:1 mounted in said housing for rotation on an eccentric shaft, annularly-closed axial seals on the sides of the piston in proximity to the piston edge, and a pair of oppositely-positioned radial seals in said housing, the improvement comprising that the axial seal on each side of the piston is composed of two seal means equidistant with respect to each other and being closed within themselves, and lubricant opening means in said side parts in proximity to at least one of said radial seals, said openings being located essentially in the interstice between said two seal means in any position of the piston, or being covered temporarily at least in part by one of said two seal means.

9 Claims, 10 Drawing Figures

Figure 1A:
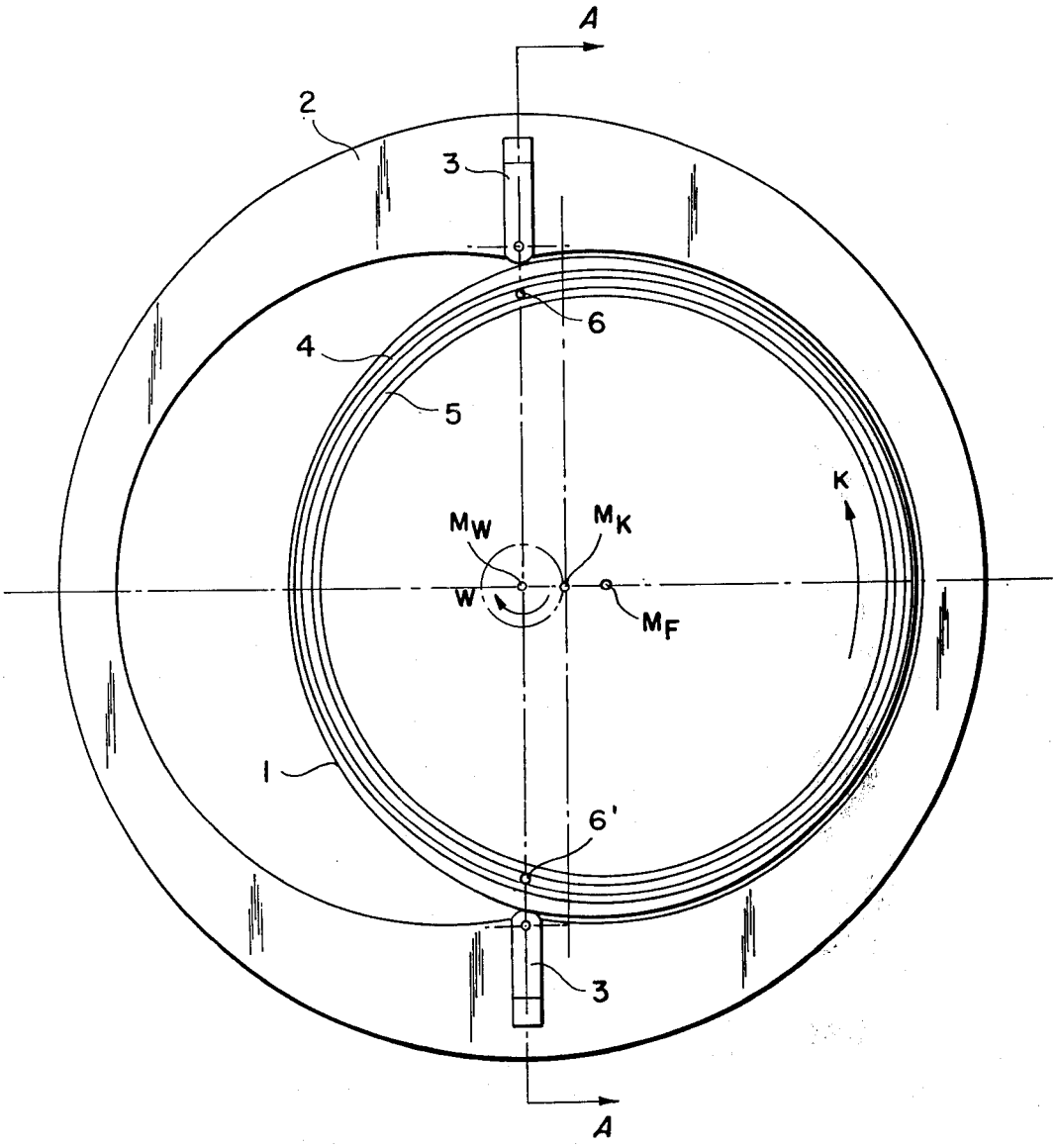

ROTARY PISTON ENGINE HAVING A TROCHOIDAL PISTON AND ANNULARLY-CLOSED AXIAL SEALS IN THE PISTON

The present invention relates to a rotary piston engine having a piston which rotates in a jacket between two side parts on an eccentric of an eccentric shaft, and which is patterned after a saddle-free epitrochoid 1:1. The piston has annularly-closed axial seals on the sides thereof and two radial seals are positioned in the jacket diametrically opposite with respect to each other.

The axial seals in the piston are generally subdivided into two seals positioned within each other, but are separated from each other by a relatively large distance, and are closed within themselves. The outwardly-positioned axial seal serves in this case as a gas check with respect to the working chamber and is therefore located as closely as possible to the piston edge. It customarily follows a curve path which is equidistant relative to the piston contour and generally is composed of two parallel sealing strips or sealing rings. The inwardly-positioned seal positioned at a relatively large distance therefrom is intended to carry out a sealing action in proximity to the eccentric shaft against oil leaking out at the eccentric shaft.

Known from German Offenlegungsschrift No. 1,551,094, is an arrangement in which specific bores are in the side parts of a rotary piston internal combustion engine of trochoidal construction for the purpose of guiding off waste oil which leaks out and is retained by the inwardly-positioned seal. These bores are so positioned that the inlet cross-sections thereof will be positioned within the outer seal in any position of the piston. A specific lubrication of the axial seal, such as is already known for example for the radial seals, does not take place here, however. Operation heretofore, if necessary, utilized the lubricating effect of the leaking oil reaching the outer axial seals due to centrifugal force, or if necessary, in internal combustion engines, with a mixture lubrication in which case a small lubricant portion reaches from the working chamber to the bordering axial seal. Yet it is necessary for many cases to provide a good lubrication also at the axial seals. This is required, for example, in internal combustion machines which suction- in only pure air, and in which therefore no mixture lubrication is possible. But even for various types of pumps, particularly in high-pressure pumps, or in pumps which feed dangerous gases, for example, a lubrication of the axial seal is required; if necessary even with an explosion-free lubricant.

It is the object of the present invention to provide for a lubrication of the axial seal in rotary piston engines of the type referred to hereinabove. In this connection it is intended to consider only the aforementioned outer seals, whereas the inner seals positioned in proximity to the eccentric shaft will not be included as genuine oil seals.

This object is obtained, in accordance with the present invention, by virtue of the fact that the axial seal is composed of two seals extending equidistantly with respect to each other and being closed within themselves, and that in the side parts in proximity to at least one of the radial seals and in the plane of the radial seals are openings for a lubricant at such a distance with respect to the radial seal that these openings terminate — in any position of the piston — essentially into the interstice between the two seals, or are covered temporarily at least in part by either one or the other adjacent seal.

In this connection it is possible for the two seals to extend either equidistantly with respect to the piston edge, or else — according to a further embodiment of the present invention — are circular and extend concentrically about the mathematical form center of the epitrochoid. Due to the trochoidal movements of the piston, the circular axial seals will assume different positions, during the rotation of the piston, with respect to the lubricant openings. As a result, and depending upon the dimensions chosen, lubricant will be introduced with certainty between the axial seals, being closed within themselves in a circular fashion, and furthermore, the supply openings for the lubricant will at least be temporarily covered either by the inner or the outer axial seal. In this manner, lubricant is supplied to the two seals positioned within each other. It is important above all in this connection that lubricant penetrates into the interstice between the two axial seals since from there it can flow into the outer sealing ring due to the centrifugal effect and there perform the required lubrication. Moreover, the sealing effect with respect to the working chambers is improved. The inner axial seal receives its lubrication by virtue of the fact that, during rotation, it slides at least temporarily over the feed opening of the lubricant. The arrangement may be made so that the openings for the lubricant supply are positioned within the area of one radial seal, and the openings for the discharge of the lubricant within the area of the other radial seal. Accordingly, the supply opening and the discharge opening are positioned diametrically opposite each other.

According to another embodiment of the engine, the supply and discharge openings also may be positioned directly next to each other within the area of a radial seal. In this case, the opening located on the running-off side — viewed in the direction of rotation of the piston — is a supply opening, and the opening located on the running-up side is a discharge opening. In each case it is possible to perform the lubrication in a manner known per se in a dosed or metered fashion. In this connection one can use the various methods for a metered lubricant supply that are already known in the art, and hence they are not further described herein.

Figure 1B:
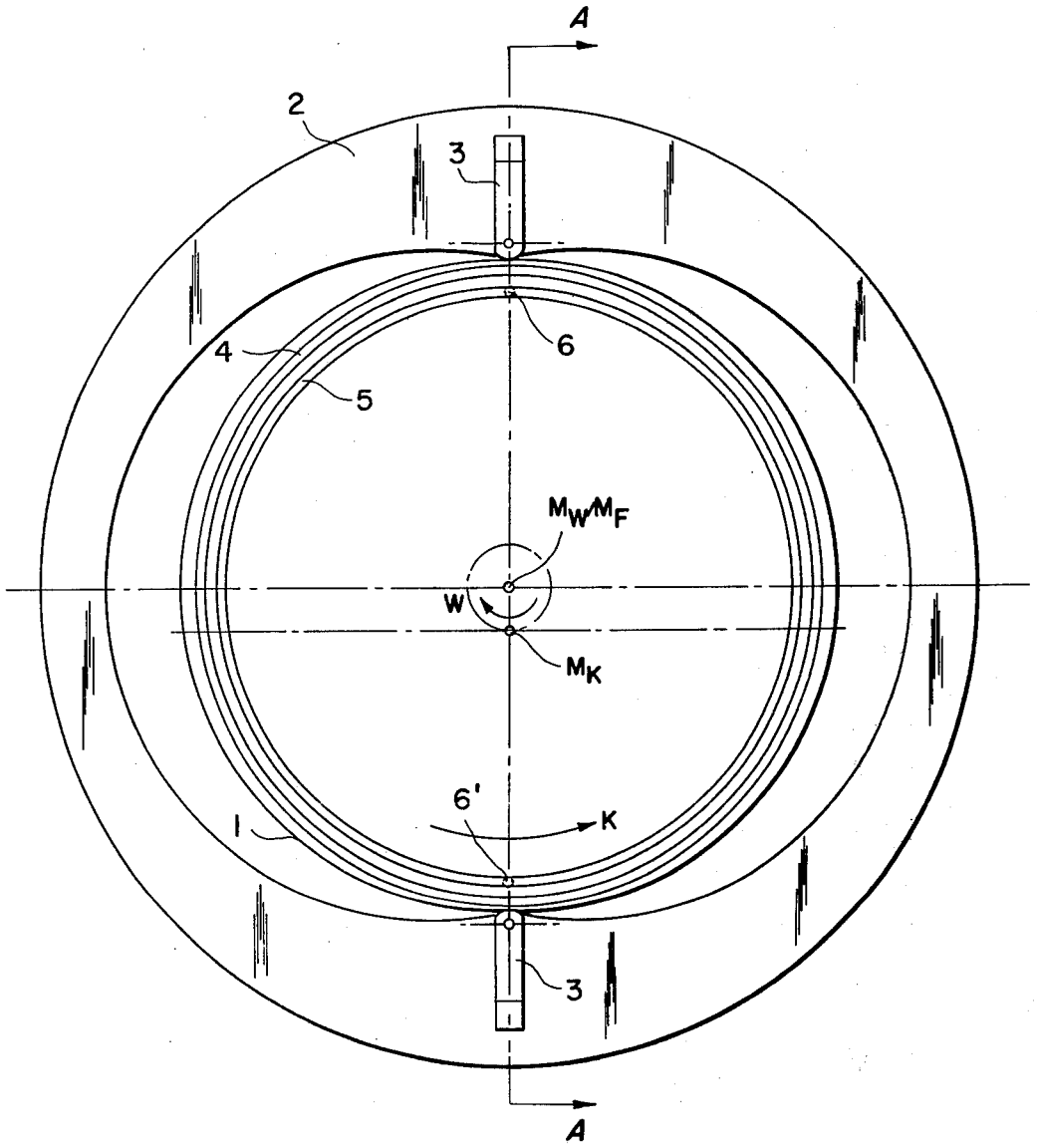
Figure 2A:
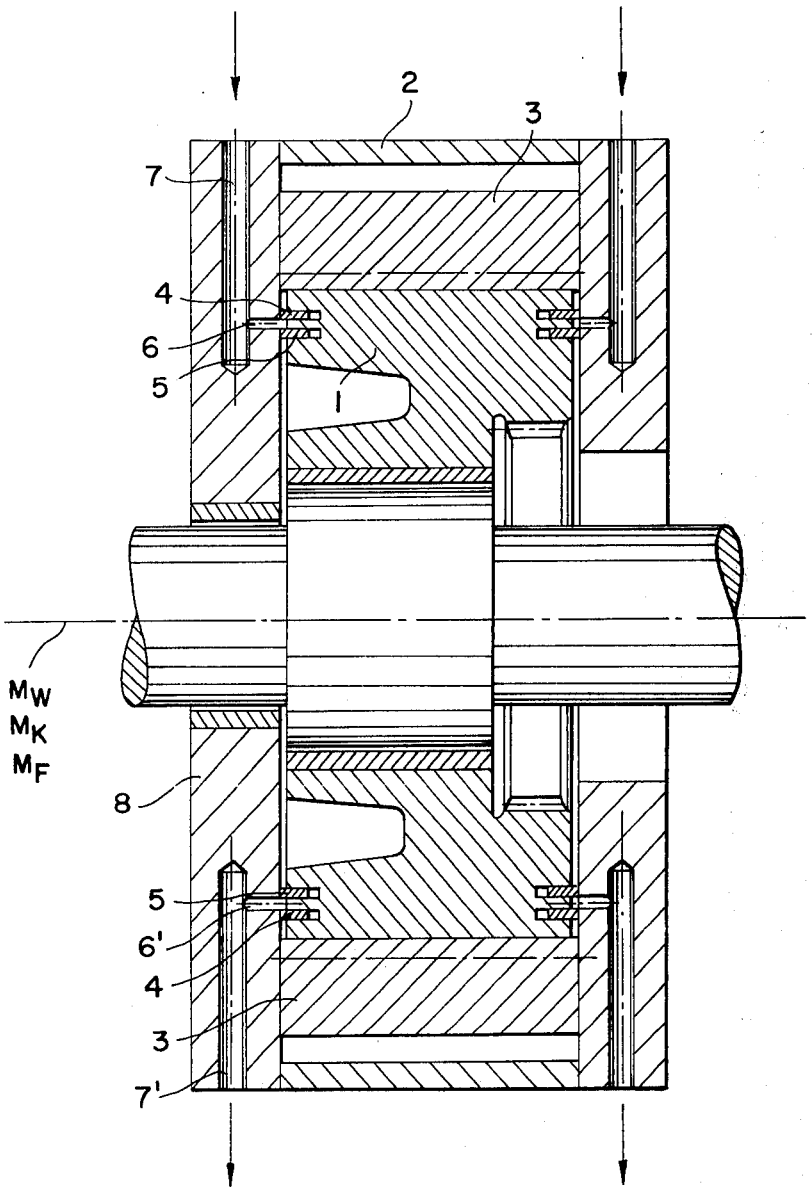
Figure 2B:
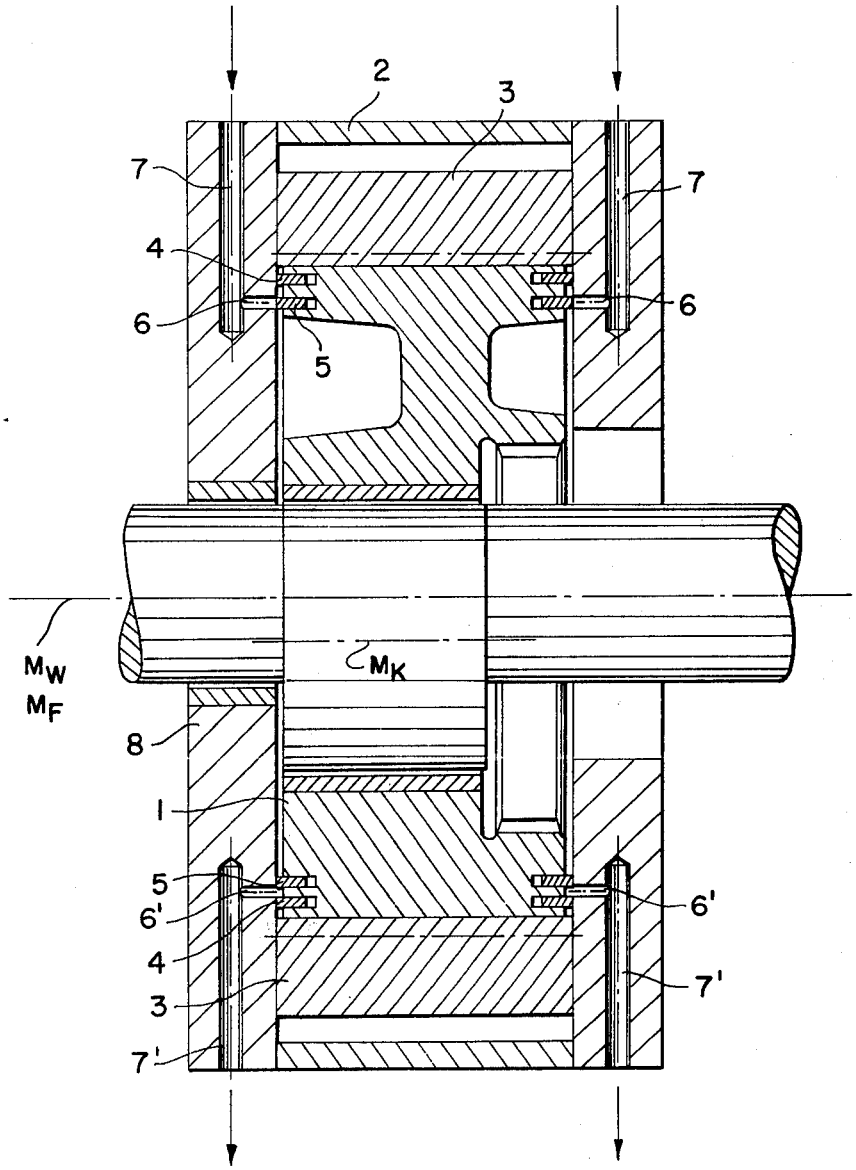
Figure 3A:
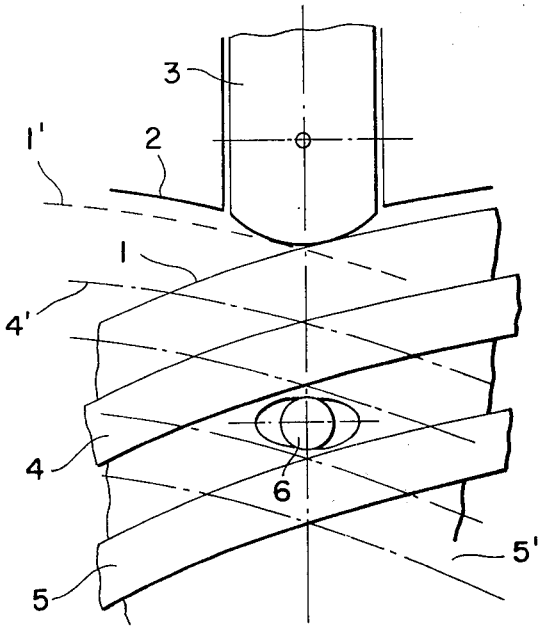
Figure 4A:
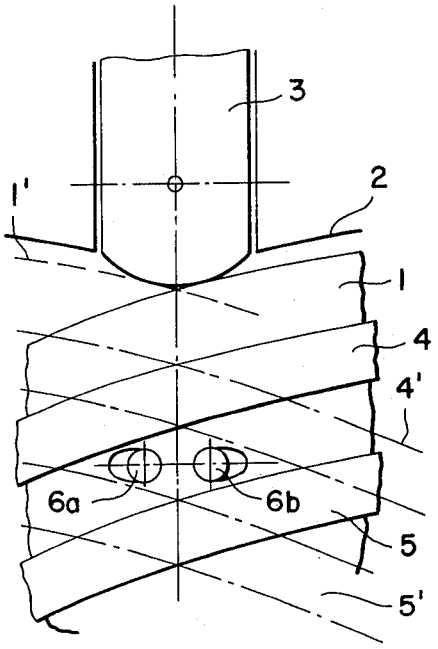
Figure 3B:
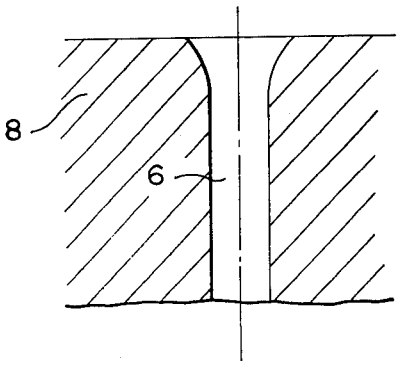
Figure 4B:
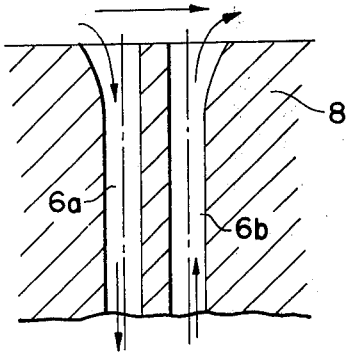
Figure 5B:
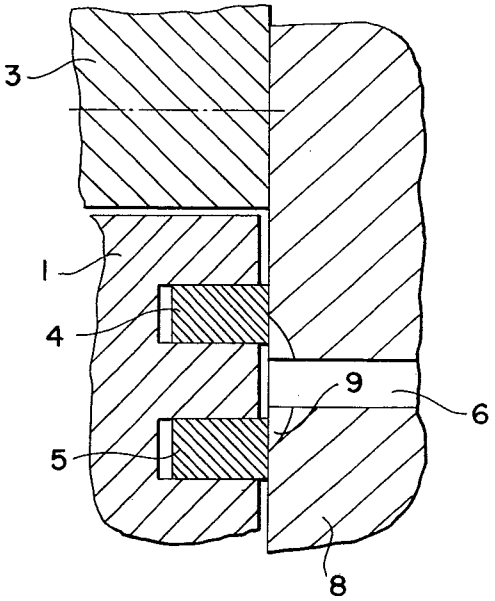
Figure 5A:
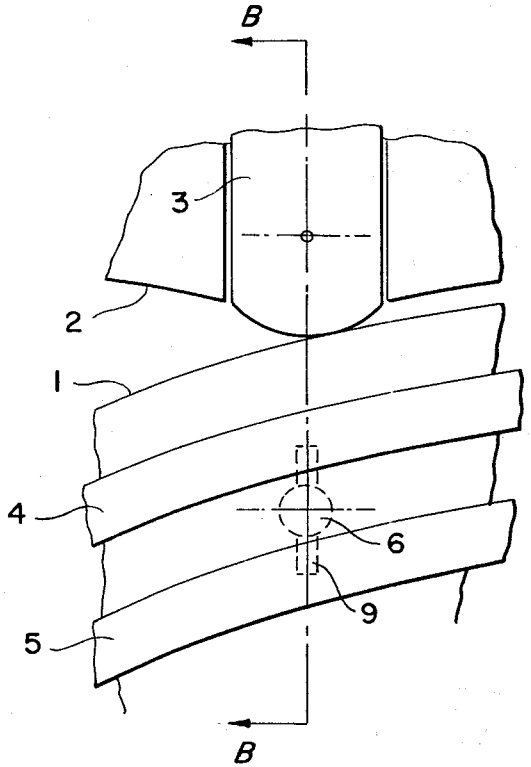

One embodiment of the present invention now will be further described hereinbelow with reference to the accompanying drawings, wherein FIG. 1*a* illustrates a piston in the upper dead-center position thereof;

FIG. 1*b* illustrates the piston in an intermediate position thereof at 90° of crankshaft rotation;

FIGS. 2*a* and 2*b* are axial cross-sectional views relative to FIGS. 1*a* and 1*b* taken along lines A—A;

FIGS. 3*a* and 3*b* represent a view, and an axial cross-sectional view of a lubricant opening, at an enlarged scale;

FIGS. 4*a* and 4*b* are modifications of FIGS. 3*a* and 3*b* with paired lubricant openings, and FIGS. 5*a* and 5*b* are further modifications of the shape of the lubricant openings.

Shown in FIGS. 1*a* and 2*a*, in a greatly simplified illustration, is a piston 1 which has the shape of a saddle-free epitrochoid 1:1. The jacket or shell surrounding the piston 1 is identified with reference numeral 2 and contains the radial seals 3. The drive shaft of the engine is identified herein with reference letters $M_W$, and the piston center is identified with reference letters $M_K$. During operation of the engine, the piston center $M_K$ moves on the crank circle, which has been shown in dash-dotted lines, in the direction of rotation W. The piston 1 itself moves at that time in the opposite direction, as has been indicated by the arrow K. Reference letters $M_F$ designate the mathematical form center of the piston 1 and of the epitrochoid. In the piston side walls are two annular axial seals 4 and 5 being closed within themselves. These axial seals do not follow the outer piston contour, as is otherwise frequently customary, i.e., as an equidistant curve path relative to the trochoid, but they are here circular, whereby the center of the circle is positioned in the mathematical shape center $M_F$ of the trochoid. In the shape of the saddle-free epitrochoid 1:1 which has been selected, the deviations of the circle shape from the exact trochoidal shape, or a curve path equidistant with respect thereto, are so slight that the different gap widths have no influence upon the sealing effect. The maximum arising gap widths remain of an order still smaller than the expansion joints of the piston rings customary in reciprocating engines.

As is apparent from FIG. 2*a*, the bores 7 are positioned in the upper portion of the side parts 8, which bores serve for the supply of lubricant. The direction of supply is indicated by arrows. From these bores 7 extend the transverse bores 6 to the side wall of the side parts 8 and terminate — as shown in FIG. 2*a* — for example between the two axial seals 4 and 5. The precise position of the transverse bore 6 is apparent from FIG. 1*a*. The supply opening 6 is positioned in the connecting plane of the two radial seals 3 and is located in the near-axis zone of the jacket or shell 2, i.e. in proximity to the radial seals 3.

In the lower portion of the side parts 8 are the corresponding bores 7' for the discharge of the lubricant. From these bores 7' the small transverse bores 6' extend to the side wall. These transverse bores 6' also terminate here in the embodiment shown between the two axial seals 4 and 5. In this embodiment it has been assumed that, in the dead-center position of the piston, the lubricant supply at 6, and the discharge of the lubricant at 6', are positioned precisely between the two axial seals 4 and 5.

Shown in FIGS. 1*b* and 2*b* is the situation which will result when the piston has been rotated out of the dead-center position by 90°. It is apparent therefrom that the supply opening 6 and the discharge opening 6' are covered by the inner axial sealing ring 5. Accordingly, the axial seals 4 and 5 travel to and fro, in comparison with FIGS. 1*a* and 2*a*, relative to the two lubricant openings 6 and 6'. At that time, the openings can be covered by either one or the other axial seal in the extreme positions of the piston 1.

In FIGS. 3*a* and 3*b*, the supply openings for the lubricant have been shown in a greatly enlarged manner. Within the jacket or shell 2 is the radial seal 3 which touches the piston 1. The piston 1 is shown in the dead-center position thereof. In the piston side wall are the two circular axial seals 4 and 5. Between the two, in the dead-center position, the lubricant supply opening 6 is free. Therefore the interstice between the two axial seals can be filled with lubricant. The dashed lines in FIG. 3*a* indicate the position of the piston in the other dead-center position. This position is designated with reference numeral 1'. Correspondingly, also the position of the axial seals is shown in dash-dotted lines and designated with reference numerals 4' and 5'. As is apparent from FIG. 3*a*, the lubricant supply opening 6 is positioned in both cases in the interstice between the two sealing rings. In the intermediate positions of the piston 1, during the travel thereof from one dead-center position into the other dead-center position thereof, the axial seals 4 and 5 will be so displaced that the opening 6 is covered at least temporarily by the inner axial seal 5, either partially or completely. As a result, a lubrication of this seal takes place. The lubrication of the outer axial seal 4 is effected from the interstice by centrifugal force. As is apparent from the axial cross-sectional view of FIG. 3*b*, the supply opening for the lubricant contains, at the orifice thereof, rounded-off portions in order that the lubricant can there emerge, and so that no accumulation is produced there. These rounded-off portions extend in the direction of rotation of the piston.

Further, in the dead-center position, the supply opening 6 also may be covered either entirely or partially by the outer axial seal 4. This will result in an additional direct lubricating effect at this seal.

As has been shown in FIGS. 1*a* and 1*b*, the supply opening 6 for the lubricant is located in proximity to one radial seal, and the discharge 6' is located in proximity to the other radial seal. They are, accordingly, positioned diametrically opposite each other. FIGS. 4*a* and 4*b*, in contrast thereto, illustrate an arrangement in which the supply and the discharge openings are positioned closely adjacent each other. In the dead-center position of the piston 1 shown in FIG. 4*a*, a supply opening 6*b* and a discharge opening 6*a* are positioned side-by-side in the interstice between the axial seals 4 and 5. The operations during the rotation of the engine are in the same manner as has been described above in connection with FIG. 3. Here again, rounded-off portions may be provided at the openings 6*a* and 6*b*, these portions being positioned in the direction of rotation of the piston 1.

In FIG. 4*b*, the direction of rotation K of the piston is indicated by an arrow, and accordingly, the bore 6*b* is used as an inflow opening, and the bore 6*a* as a discharge opening for the lubricant. The supply opening is positioned on the running-off side, and the discharge opening is positioned on the running-up side of the connecting plane for the two radial seals.

The construction mentioned above in which the axial seals extend equidistantly with respect to the piston edge is not specifically illustrated herein. It differs from the embodiment described above in connection with FIGS. 1 and 2 only by reason of the fact that the axial seals merely change the position thereof, or expressed more precisely, the inclination thereof, with respect to the lubricant openings and the connecting plane of the two radial seals, but not their distance from the radial seal or from the openings, for as a consequence of the equidistance with respect to the piston edge, the axial seals follow the genuine trochoidal movement. As a result, the axial seals will not cover or sweep over the openings during rotation of the engine, if the openings terminate, in the dead-center position of the piston, precisely in the interstice between the two seals. The openings therefore advantageously will have an elongated form in a manner such that they extend approximately in a slot-like manner in the connecting plane of the two radial seals, and are thus covered at the outer and inner ends thereof by the adjacent axial seals. In this manner, the lubricant here again can directly reach the axial seals.

This configuration of the openings is schematically illustrated in FIGS. 5*a* and 5*b*. FIG. 5*a* is a fragmentary view, and FIG. 5*b* is a fragmentary cross-sectional view taken along line B—B of FIG. 5*a*. The piston again is identified with reference numeral 1 therein. In the side surface thereof are the seals 4 and 5 equidistantly to the piston edge. The opening 6 in the side part 8 terminates in the interstice between the two seals 4 and 5. The opening 6 is widened — for example by milling — to form a slot 9 which extends toward the radial seal 3. The two ends of the slot 9 are covered at all times during rotation of the engine by the two adjacent seals 4 and 5 so that an excellent lubricating and sealing effect at the axial seals is attained.

All of the features enumerated herein may be exchanged with each other and used in any combination desired.

It will be obvious to those skilled in the art that many modifications may be made within the scope of the present invention without departing from the spirit thereof, and the invention includes all such modifications.

What is claimed is:

1. In a rotary piston machine comprising a jacket and two side parts forming a housing, inlet and outlet means on said housing, a piston patterned after a saddle-free epitrochoid 1:1 mounted in said housing for rotation on an eccentric shaft, annularly-closed axial seals on the sides of the piston in proximity to the piston edge, and a pair of oppositely-positioned radial seals in said housing, the improvement which comprises that the axial seal on each side of the piston is composed of two seal means equidistant with respect to each other and being closed within themselves, and lubricant opening means in said side parts in proximity to and in the plane of at least one of said radial seals, said openings being located in the interstice between said two seal means or being covered temporarily at least in part by one of said two seal means as the piston rotates.

2. A rotary piston machine according to claim 1 in which said two seal means are equidistant with respect to the piston edge.

3. A rotary piston machine according to claim 1 in which said lubricant opening means have an elongated shape extending between said two seal means.

4. A rotary piston machine according to claim 1 in which said two seal means are concentric with the mathematical shape center of the epitrochoid, said lubricant opening means, in the dead-center position of the piston, being located in the interstice between said two seal means, and, during rotation of the piston, said two seal means move with respect to said lubricant opening means so that at least the inwardly-positioned seal means temporarily and partially covers said lubricant opening means.

5. A rotary piston machine according to claim 1 including means for metering a supply of lubricant to said lubricant opening means.

6. A rotary piston machine according to claim 1 in which one lubricant opening means is in proximity to one radial seal and acts as a supply opening, and another lubricant opening means is in proximity to the other radial seal and acts as a discharge opening.

7. A rotary piston engine according to claim 6 in which said lubricant opening means have rounded-off portions in the direction of rotation of the piston, both in the direction of the running-off part and the running-up part.

8. A rotary piston machine according to claim 1 in which said lubricant opening means are a pair of openings in tandem in the area of one radial seal, the opening on the running-off part of the piston being a supply opening, and the opening on the running-up part of the piston being a discharge opening.

9. A rotary piston machine according to claim 8 in which said supply opening has a rounded-off portion in the direction of rotation of the piston, and the discharge opening has a rounded-off portion in the direction of the running-up part of the piston.

* * * * *